US008333092B2

(12) United States Patent
Shimoda et al.

(10) Patent No.: US 8,333,092 B2
(45) Date of Patent: Dec. 18, 2012

(54) PIERCER, PLUG AND METHOD OF MANUFACTURING SEAMLESS PIPE OR TUBE

(75) Inventors: Kazuhiro Shimoda, Osaka (JP); Tomio Yamakawa, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 622 days.

(21) Appl. No.: 11/922,089

(22) PCT Filed: Jun. 14, 2006

(86) PCT No.: PCT/JP2006/311904

§ 371 (c)(1),
(2), (4) Date: Dec. 14, 2009

(87) PCT Pub. No.: WO2006/134957

PCT Pub. Date: Dec. 21, 2006

(65) Prior Publication Data

US 2010/0089111 A1 Apr. 15, 2010

(30) Foreign Application Priority Data

Jun. 14, 2005 (JP) ..... 2005-173203

(51) Int. Cl.
*B21B 19/04* (2006.01)

(52) U.S. Cl. ..... 72/97; 72/209

(58) Field of Classification Search ..... 72/41, 42, 72/46, 68, 97, 208, 209, 348, 462, 476
See application file for complete search history.

(56) References Cited

U.S. PATENT DOCUMENTS

| | | | | |
|---|---|---|---|---|
| 3,712,103 | A * | 1/1973 | Malegue | 72/264 |
| 4,370,879 | A * | 2/1983 | Kopysky et al. | 72/377 |
| 4,520,902 | A * | 6/1985 | Snow | 184/7.4 |
| 4,848,124 | A * | 7/1989 | Biller et al. | 72/97 |
| 6,988,387 | B2 * | 1/2006 | Nakaike et al. | 72/97 |
| 7,037,049 | B2 * | 5/2006 | Toublanc | 407/11 |
| 7,100,410 | B2 * | 9/2006 | Yamakawa et al. | 72/97 |

FOREIGN PATENT DOCUMENTS

| | | |
|---|---|---|
| JP | 51-133167 | 11/1976 |
| JP | 1-180712 | 7/1989 |
| JP | 2-224805 | 9/1990 |
| JP | 10-235413 | 9/1998 |
| JP | 2003-001305 | 1/2003 |

* cited by examiner

*Primary Examiner* — Dana Ross
*Assistant Examiner* — Homer Boyer
(74) *Attorney, Agent, or Firm* — Clark & Brody

(57) ABSTRACT

A plug 2 used for a piercer according to the invention includes a tip end portion 23, a cylindrical portion 24, a barrel portion 25, a mandrel coupling portion 22, and an injection hole 21. The injection hole 21 penetrates from the surface of the cylindrical portion 24 to the surface of the mandrel coupling portion 22 and an externally supplied lubricant is injected from the hole. A clearance forms between the pierced material and the cylindrical portion 24. The injection hole 21 is formed at the cylindrical portion 24, and therefore the material in the process of piercing does not contact the injection hole 21. Therefore, an inner surface defect attributable to the contact between the material and the injection hole 21 can be prevented from being generated.

6 Claims, 9 Drawing Sheets

PIERCER, PLUG AND METHOD OF MANUFACTURING SEAMLESS PIPE OR TUBE

TECHNICAL FIELD

The present invention relates to a piercer, a plug, and a method of manufacturing a seamless pipe or tube, and more particularly to a piercer used to pierce a material into a seamless pipe or tube, a plug for use in the piercer, and a method of manufacturing a seamless pipe or tube.

BACKGROUND ART

A piercer used to produce a metal pipe or tube (hereinafter referred to as "pipe") pierces a round billet as a material and makes it into a hollow shell. The hollow shell is further subjected to hot working using for example an elongator and a mandrel mill and formed into a seamless pipe.

As shown in FIG. 7, the piercer includes a pair of inclined rolls 1 each inclined with respect to a pass line PL, a plug 100, and a mandrel 3 having its front end coupled with the rear end of the plug 100. While turning a billet 50 between the inclined rolls 1 in the circumferential direction, the piercer presses the billet 50 into the plug 100, thus pierces the billet 50 and makes it into a hollow shell 51.

When the billet is pierced with the piercer and formed into the hollow shell, a defect could be formed on the inner surface of the hollow shell (hereinafter referred to as "inner surface defect") in some cases. The inner surface defects are generated by the following mechanism. During piercing, a fracture due to the Mannesmann effect is caused in the center of the billet upstream of the plug tip end. The fracture due to the Mannesmann effect is subjected to circumferential shear distortion by the inclined rolls and the plug during the piercing. As a result, the fracture due to the Mannesmann effect extends in the circumferential direction to form an inner surface defect.

In order to effectively reduce such inner surface defects caused by the fracture due to the Mannesmann effect, the friction coefficient of the plug surface should be reduced. The reduction in the friction coefficient of the plug surface increases the advancing speed of the billet in the process of piercing. If the advancing speed increases, the rotary forging effect is restricted. Furthermore, such reduction in the friction coefficient can reduce the circumferential shear strain. Therefore, the fracture due to the Mannesmann effect can be prevented from being extended, and the inner surface defects can be restricted.

The reduction in the friction coefficient prevents the plug from being worn or eroded. Therefore, inner surface defects caused by irregularities formed on the plug surface because of the friction or erosion can be prevented.

According to one disclosed technique, a lubricant is injected from an injection hole provided at the plug while the billet is pierced so that the friction coefficient of the plug is reduced. JP 1-180712 A and JP 10-235413 A each disclose a method of piercing while a lubricant is injected from an injection hole provided at the tip end of the plug. The disclosed tip ends of the plugs however each contact the billet. Therefore, in order to inject the lubricant from the injection hole provided at the tip end of the plug, the lubricant must be injected at pressure not less than the deforming resistance of the billet in contact with the tip end. Furthermore, the injection hole could be destroyed by contacting the billet.

JP 51-133167 A discloses a method of injecting a lubricant from a plug without providing the lubricant with additional high pressure. As shown in FIG. 8, the disclosed plug 101 includes a tip end portion 102 having a raised curvature in the axial direction, a cylindrical portion 103 having a fixed outer diameter, and a barrel portion 104 having an outer diameter gradually increased from its front end to its rear end. An injection hole 105 is provided at the part of the barrel portion 104 adjacent to the cylindrical portion 103. When the billet 50 is pierced using the plug 101, a prescribed clearance 60 forms between the inner surface of the billet and the plug surface. During the piercing, although the cylindrical portion 103 deforms to narrow the clearance 60, the clearance 60 allows the injection hole to be kept open and a fixed amount of lubricant to be supplied.

However, the plug 101 could cause an inner surface defect to the billet during the piercing. The injection hole 105 is provided at the part of the barrel portion 104 adjacent to the cylindrical portion 103. Therefore, as shown in FIG. 9, the billet 50 in the process of piercing can contact the upper part of the opening of the injection hole 105. The contact may cause an inner surface defect at the billet 50. Furthermore, if the billet 50 is in contact with the opening of the injection hole 105, the injection hole 105 may be eroded and clogged.

In the plug 101, the lubricant may be solidified to clog the injection hole 105 in some cases. During the piercing, the billet 50 is in contact with a part of the surface of the barrel portion 104 in the vicinity of the injection hole 105. Therefore, the temperature of the opening of the injection hole 105 approximates to the temperature of the billet to attain a high temperature. Therefore, if a glass-based lubricant is used, the lubricant can be solidified in the injection hole 105 and clog the injection hole 105 in some cases.

DISCLOSURE OF THE INVENTION

It is an object of the invention to provide a piercer, a plug, and a method of seamless pipe that allow an inner surface defect to be prevented from forming at a billet in the process of piercing and rolling because of an injection hole for a lubricant provided at the plug.

Another object of the invention is to provide a piercer, a plug, and a method of manufacturing a seamless pipe that allow an injection hole provided at the plug to be prevented from being clogged.

A piercer according to the invention is used to pierce and roll a material in the axial direction and form the material into a hollow shell. The piercer includes a plug having an injection hole used to inject a lubricant, a mandrel having a through hole in the axial direction to let the lubricant flow therethrough and having its tip end coupled with the rear end of the plug, and an injection device used to inject the lubricant from the injection hole through the through hole. The plug includes a tip end portion, a cylindrical portion, a barrel portion, and a mandrel coupling portion. The tip end portion has a raised curvature in the axial direction. The cylindrical portion is adjacent to the tip end portion and has a substantially cylindrical surface. The barrel portion is adjacent to the cylindrical portion and has an outer diameter gradually increased from its front end to its rear end. The mandrel coupling portion is provided at the rear end of the plug to couple with the mandrel. The injection hole penetrates from the surface of the cylindrical portion to the surface of the mandrel coupling portion and is communicated with the through hole.

When a billet is pierced and rolled by the piercer according to the invention, the billet pierced and rolled does not contact the cylindrical portion of the plug and the part of the barrel portion adjacent to the cylindrical portion. Meanwhile, the injection hole is formed at the surface of the cylindrical portion, and therefore there is always a clearance between the injection hole and the billet, so that the injection hole does not contact the inner surface of the billet. Therefore, high pressure is not necessary to inject the lubricant.

Furthermore, if the injection hole is provided at the barrel portion, the billet could contact the injection hole and cause an inner surface defect, but the injection hole of the plug according to the invention is formed at the cylindrical portion, so that the material does not contact injection hole. Therefore, an inner surface defect attributable to such contact between the injection hole and the billet is not generated.

The injection hole preferably penetrates from the part of the surface of the cylindrical portion adjacent to the barrel portion to the surface of the mandrel coupling portion.

During the piercing and rolling, in the position of the clearance between the billet and the plug, particularly at the adjacent part between the cylindrical portion and the barrel portion, the distance from the plug surface to the billet is the largest. The injection hole is formed at the adjacent part of the surface of the cylindrical portion, and therefore the distance from the injection hole to the billet is large, so that the injection hole is not easily affected by heat from the billet. Therefore, if a glass-based lubricant is used, the lubricant can be prevented from being solidified in the injection hole, and the injection hole can be prevented from being clogged with the solidified lubricant.

A method of manufacturing a seamless pipe according to the invention uses the piercer described above and includes the steps of piercing and rolling a material in the axial direction and injecting a lubricant from the injection hole of the plug while the material is pierced and rolled.

A plug according to the invention is for use in a piercer used to pierce and roll a billet in the axial direction and form the billet into a hollow shell. The plug includes a tip end portion, a cylindrical portion, a barrel portion, a mandrel coupling portion, and an injection hole. The tip end portion has a raised curvature in the axial direction. The cylindrical portion is adjacent to the tip end portion and has a substantially cylindrical surface. The barrel portion is adjacent to the cylindrical portion and has an outer diameter gradually increased from its front end to its rear end. The mandrel coupling portion is provided at the rear end of the plug to couple with a mandrel. The injection hole penetrates from the surface of the cylindrical portion to the surface of the mandrel coupling portion and is used to inject a lubricant.

When a billet is pierced and rolled using the plug according to the invention, the billet pierced and rolled does not contact the cylindrical portion of the plug and the part of the barrel portion adjacent to the cylindrical portion. The injection hole is formed at the surface of the cylindrical portion, and therefore there is always a clearance between the injection hole and the billet, so that the injection hole does not contact the inner surface of the billet. Therefore, high pressure is not necessary to inject the lubricant.

Furthermore, if the injection hole is provided at the barrel portion, the billet could contact the injection hole and cause an inner surface defect, but the injection hole of the plug according to the invention is formed at the cylindrical portion, so that the billet does not contact injection hole. Therefore, an inner surface defect attributable to such contact between the injection hole and the billet is not generated.

The injection hole preferably penetrates from the part of the surface of the cylindrical portion adjacent to the barrel portion to the surface of the mandrel coupling portion.

During the piercing and rolling, in the position of the clearance between the billet and the plug, particularly at the adjacent part between the cylindrical portion and the barrel portion, the distance from the plug surface to the billet is the largest. The injection hole is formed at the adjacent part of the surface of the cylindrical portion, and therefore the distance from the injection hole to the billet is large, so that the injection hole is not easily affected by heat from the billet. Therefore, if a glass-based lubricant is used, the lubricant can be prevented from being solidified in the injection hole, and the injection hole can be prevented from being clogged with the solidified lubricant.

BEST MODE FOR CARRYING OUT THE INVENTION

Figure 1:
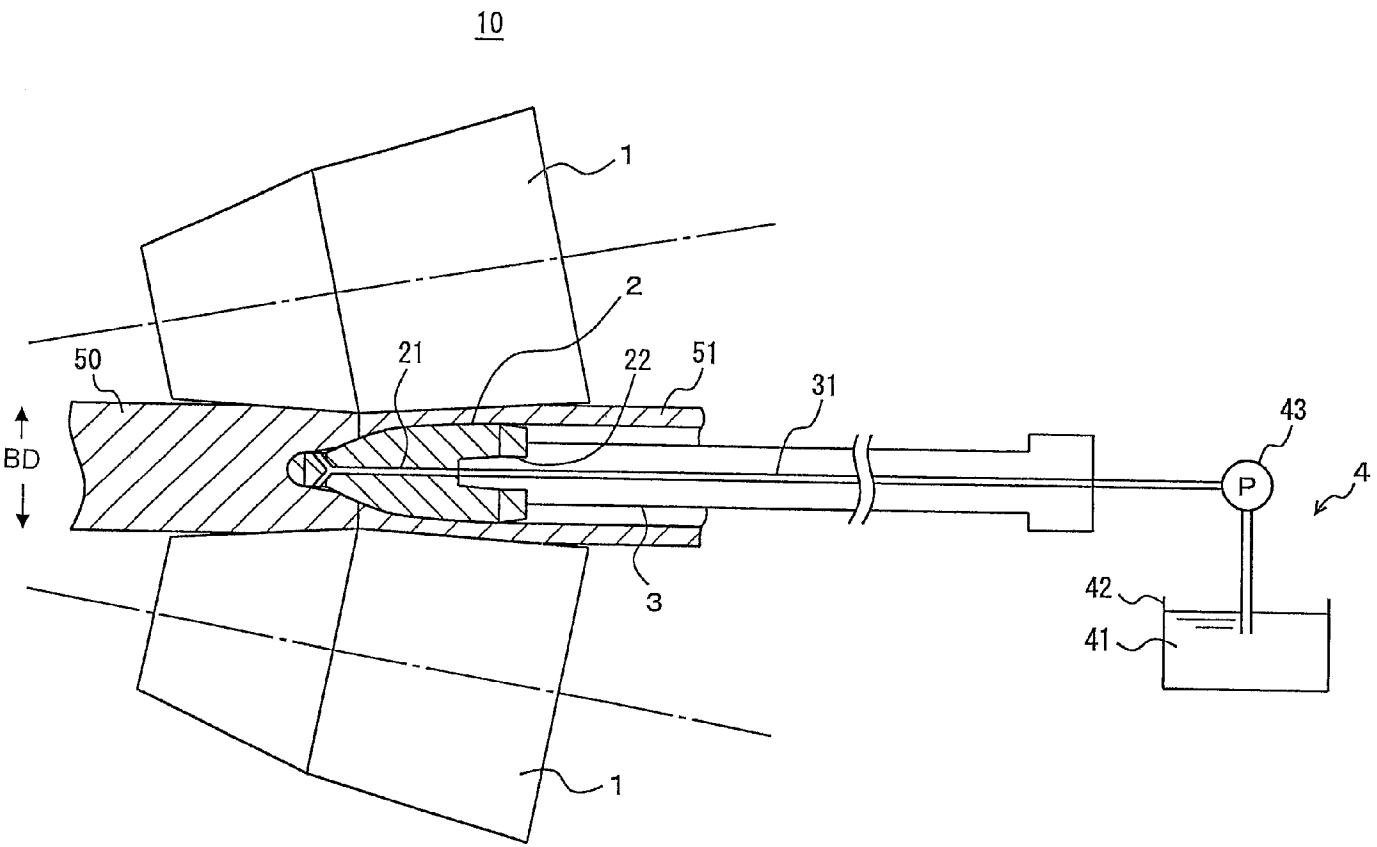
FIG. 1 is a side view of a piercer according to an embodiment of the invention.

Now, an embodiment of the invention will be described in detail in conjunction with the accompanying drawings, in which the same or corresponding portions are denoted by the same reference characters and their description is not repeated.

1. Structure of Piercer

Referring to FIG. 1, a piercer 10 includes a pair of inclined rolls 1, a plug 2, a mandrel 3, and an injection device 4.

The plug 2 has an injection hole 21 used to inject a lubricant. The mandrel 3 has its tip end fitted to a mandrel coupling portion 22 provided at the rear end of the plug 2 and coupled with the plug 2. The mandrel 3 has a through hole 31 penetrating from its front end to its rear end in the axial direction. The through hole 31 is in communication with the injection hole 21 when it is coupled with the plug 2.

The injection device 4 includes a tank 42 that stores a lubricant 41 and a pump 43. The pump 43 pumps the lubricant 41 into the through hole 31 and the injection hole 21 and has the lubricant 41 injected from the surface of the plug 2.

The rear end of the mandrel 3 was coupled to a rotary joint that is not shown. At the time, the mandrel 3 is coupled pivotably in the circumferential direction. The inclined rolls 1 in FIG. 1 may be cone type rolls or barrel type rolls. The piercer 10 shown in FIG. 1 is a two-roll type device having two inclined rolls 1, while a three-roll type device having three inclined rolls may be employed.

2. Structure of Plug

Figure 2A:
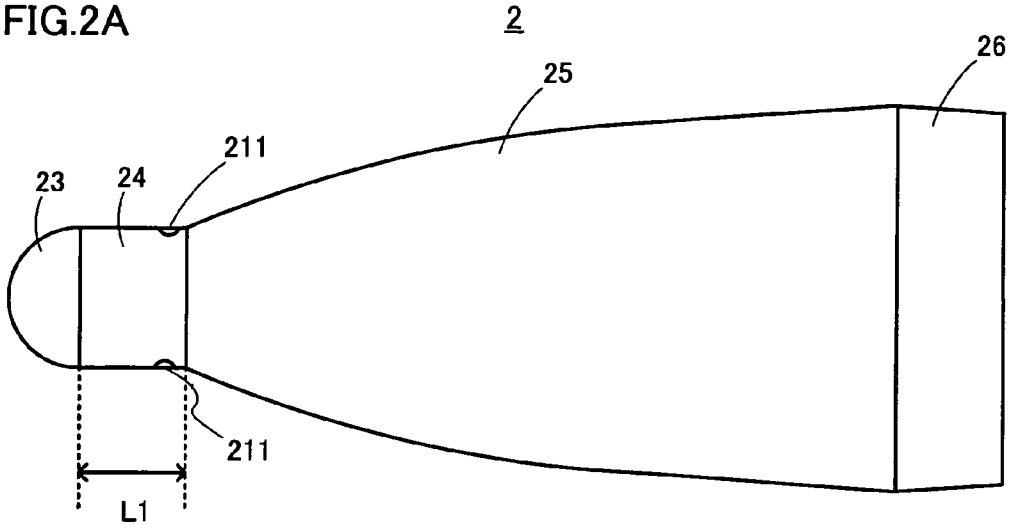
FIG. 2A is a side view of the plug shown in FIG. 1.
Figure 2B:
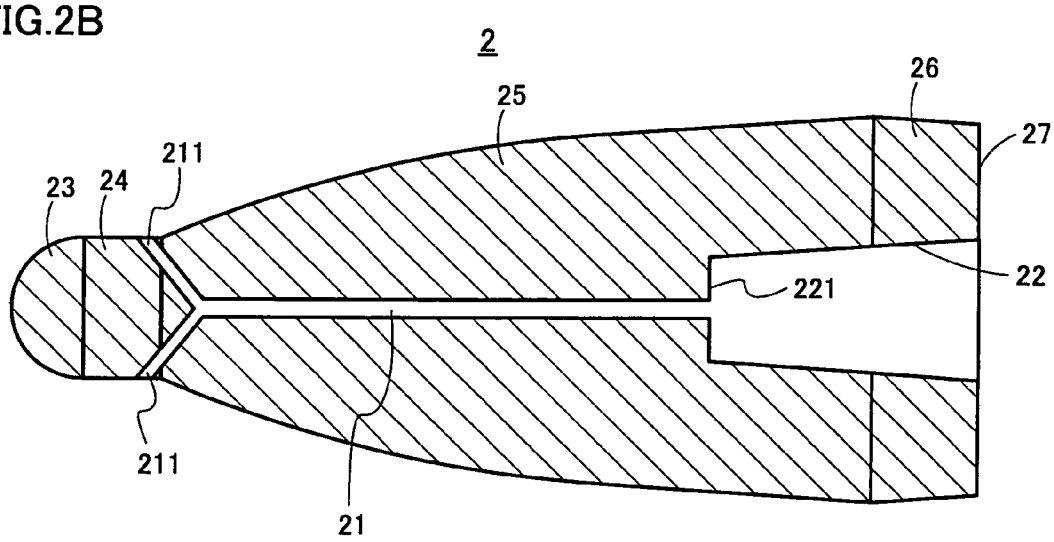
FIG. 2B is a longitudinal sectional view of the plug in FIG. 1.

Referring to FIGS. 2A and 2B, the plug 2 includes a tip end portion 23, a cylindrical portion 24, a barrel portion 25, and a flank portion 26.

The tip end portion 23 is provided at the front part of the plug 2 and has a raised curvature in the axial direction. The billet is pressed against the tip end portion 23, and a hole is formed in the center of the billet by the tip end portion 23.

The cylindrical portion 24 is provided adjacent to the tip end portion 23. The cylindrical portion 24 has a substantially cylindrical surface. The plug 2 is thus provided with the cylindrical portion 24, so that the cylindrical portion 24 does not contact the billet. In short, a clearance may be formed between the plug surface and the inner surface of the billet in the process of piercing.

The barrel portion 25 is provided adjacent to the cylindrical portion 24. The barrel portion 25 has a circular cross section and the diameter of the barrel portion 25 gradually increases from the front end to the rear end of the barrel portion 25. As will be described, the barrel portion 25 contacts the billet (hollow shell) to expand the inner diameter of the hollow shell and has the billet rolled between the inclined rolls 1 so that the hollow shell has a desired thickness.

The flank portion 26 is provided adjacent to the barrel portion 25. The diameter of the cross section of the flank portion 26 gradually decreases from the front end to the rear end of the flank portion 26. Therefore, the flank portion 26 does not contact the inner surface of the hollow shell in the process of piercing and rolling. The flank portion 26 serves to prevent the rear end of the plug from contacting the hollow shell and producing inner surface defects.

The mandrel coupling portion 22 to couple with the mandrel 3 is provided at the rear end of the plug 2. The mandrel coupling portion 22 is a non-penetrating hole having a prescribed length from the center of the rear end surface 27 of the plug toward the tip end of the plug. The tip end of the mandrel 3 is fitted into the mandrel coupling portion 22 according to a well-known method, so that the plug 2 and the mandrel 3 are coupled.

The plug 2 further has an injection hole 21. The injection hole 21 penetrates from the surface of the cylindrical portion 24 to the bottom surface 221 as the surface of the mandrel coupling portion 22. The injection hole 21 branches into two paths from one path midway between the bottom surface 221 and the surface of the cylindrical portion 24. The branched paths each reach the surface of the cylindrical portion 24 and form an opening 211.

When the mandrel 3 is fitted into the mandrel coupling portion 22, the injection hole 21 is coupled with the through hole 31 of the mandrel 3. A lubricant pumped from the injection device 4 is injected from the opening 211 through the communicated through hole 31 and the injection hole 21.

Note that the material of the plug 2 is the same as that of a well-known plug.

3. Method of Manufacturing Seamless Pipe

To start with, a billet (round billet) is inserted into a well-known heating furnace and heated. The heated billet is taken out from the heating furnace. Then, using the piercer 10 shown in FIG. 1, the taken out billet 50 is pierced and rolled into a hollow shell 51.

Figure 3:
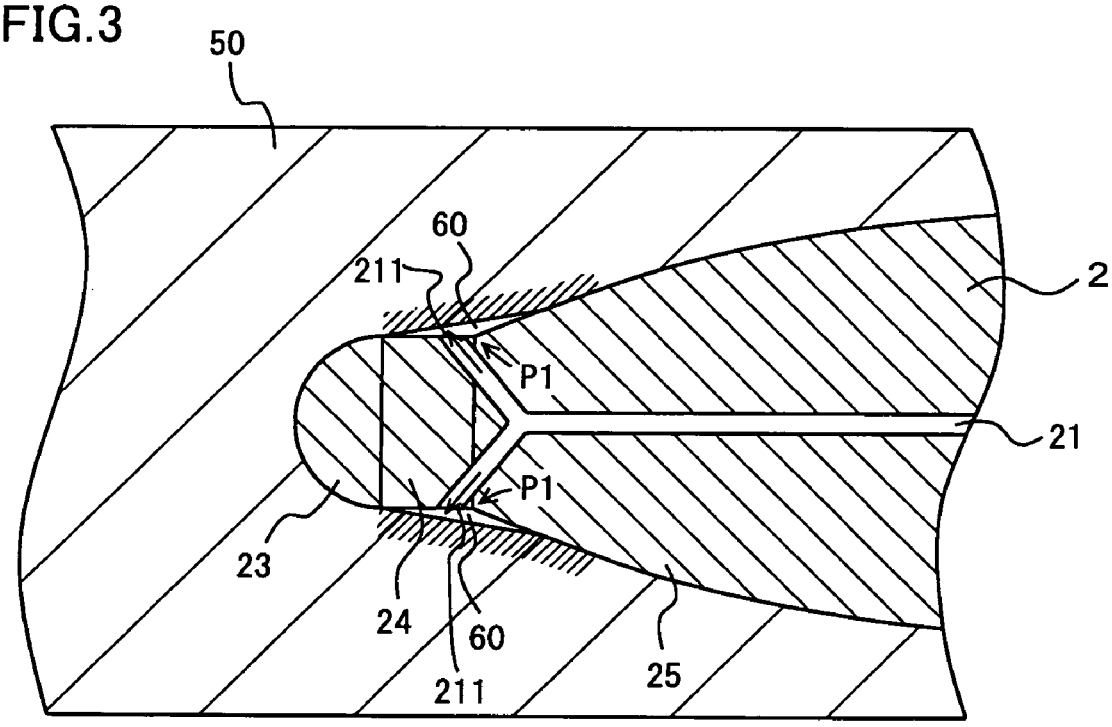
FIG. 3 is a schematic view for illustrating the state of the billet and the plug in the process of piercing.

While the billet 50 is pierced and rolled, the injection device 4 pumps the lubricant 41 and has the lubricant injected from the opening 211 of the plug 2. Referring to FIG. 3, while being pierced and rolled, the billet 50 contacts the tip end portion 23, is then kept from contacting the cylindrical portion 24 and the front end of the barrel portion 25, and again contacts the surface of the barrel portion 25 beyond the front end of the barrel portion 25. The opening 211 of the injection hole 21 is formed on the surface of the cylindrical portion 24, and therefore the lubricant is injected toward the clearance 60. Therefore, high pressure is not necessary to inject the lubricant.

Figure 9:
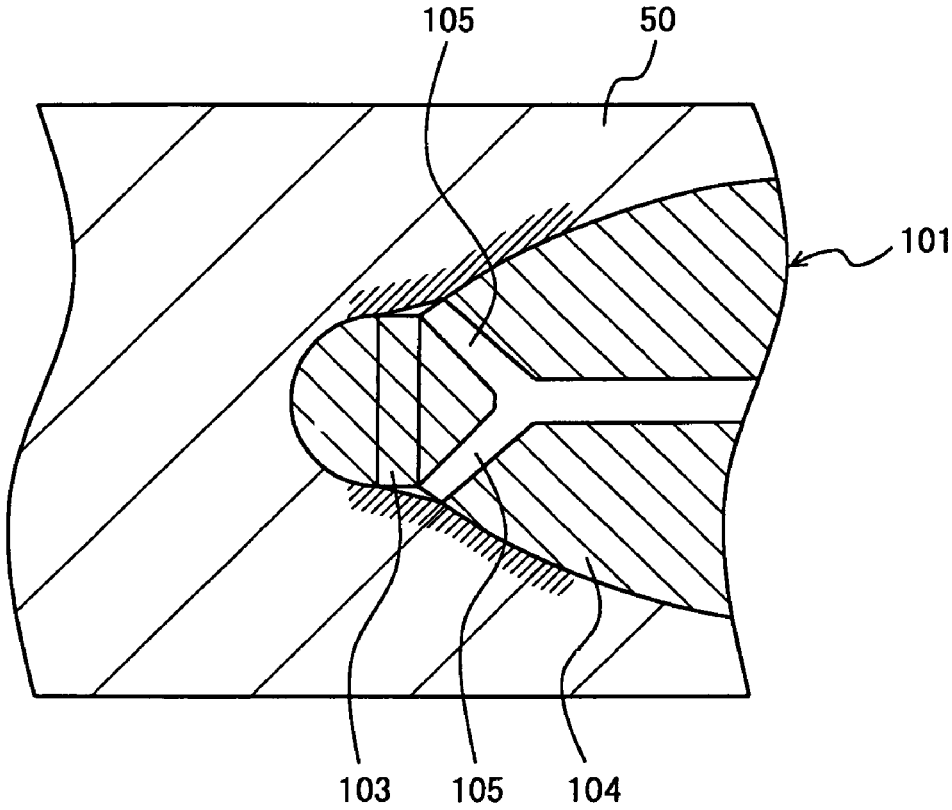
FIG. 9 is a schematic view for illustrating problems associated with the plug shown in FIG. 8.

As shown in FIG. 9, if the opening of the injection hole is formed at the plug barrel portion, the billet 50 would contact the opening of the injection hole 105 and an inner surface defect would be caused in some cases. In contract, the opening 211 of the plug 2 is formed at the cylindrical portion 24 so that billet 50 does not contact the opening 211 as shown in FIG. 3. Therefore, an inner surface defect attributable to the contact of the opening 211 and the billet is not caused. Furthermore, since the opening 211 does not contact the billet 50, it is not be destroyed by contacting the billet 50.

The opening portion 211 is formed at the part of the surface of the cylindrical portion 24 adjacent to the barrel portion 25. At the surface of the plug 2 in the clearance 60, the adjacent part P1 between the cylindrical portion 24 and the barrel portion 25 has the largest distance to the billet 50. Therefore, the adjacent part P1 is least affected by heat radiated from the billet at the surface of the cylindrical portion 24. Therefore, the opening 211 formed in the vicinity of the adjacent portion P1 is not easily affected by the heat of the billet 50, so that a glass-based lubricant is not easily solidified in the vicinity of the opening 211. In short, the opening 211 is apart from the billet 50 and therefore is unlikely to be clogged.

Note that the lubricant 41 is injected while the billet is pierced and rolled but not while the billet is not pierced and rolled. The piercer 10 includes a load sensor (not shown) used to detect the load applied on the inclined rolls 1. The injection device 4 pumps the lubricant 41 in response to a load signal output when the load sensor detects a load. In this way, the lubricant 41 can be injected only during the piercing and rolling operation. The load sensor is used in the above described example, but it may be determined whether the piercing and rolling is in progress using any other sensor.

After the billet is pierced and rolled into a hollow shell, the hollow shell is drawn and rolled using a plug mill, a mandrel mill, or the like. After the drawing and rolling, the hollow shell has its shape corrected by a stretch reducer, a reeler, a sizer, or the like and is formed into a seamless pipe.

The piercer, the plug, and the method of manufacturing a seamless pipe according to the embodiment have been described in the foregoing, while the plug may have a different structure from the above-described structure.

Figure 4:
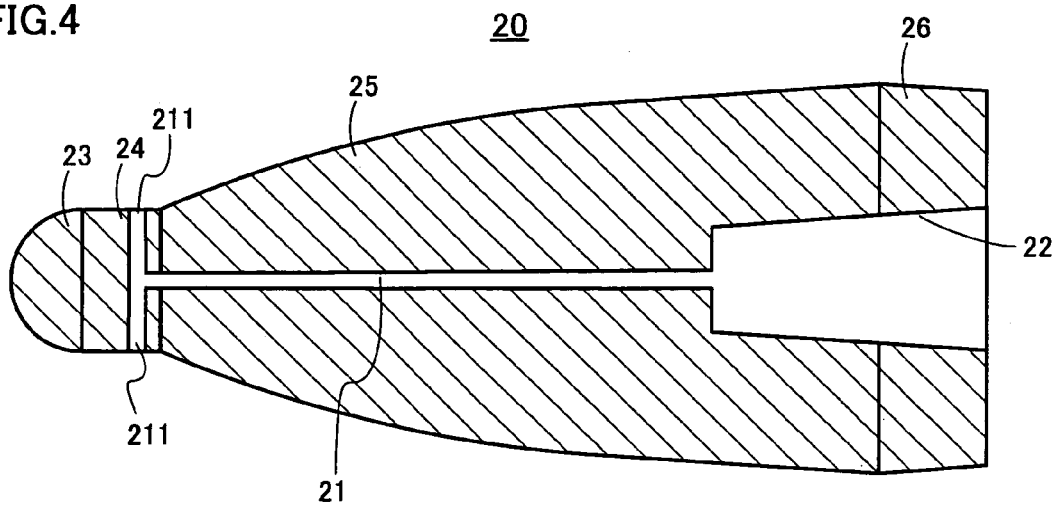
FIG. 4 is a longitudinal sectional view of another plug having a different shape from that in FIGS. 2A and 2B.

For example, as shown in FIG. 4, the shape of the branch part in the injection hole 21 may be a T-shape instead of the Y-shape. As long as the opening 211 of the injection hole 21 is formed at the surface of the cylindrical portion 24, the shape of the injection hole 21 is not restricted.

Figure 5:
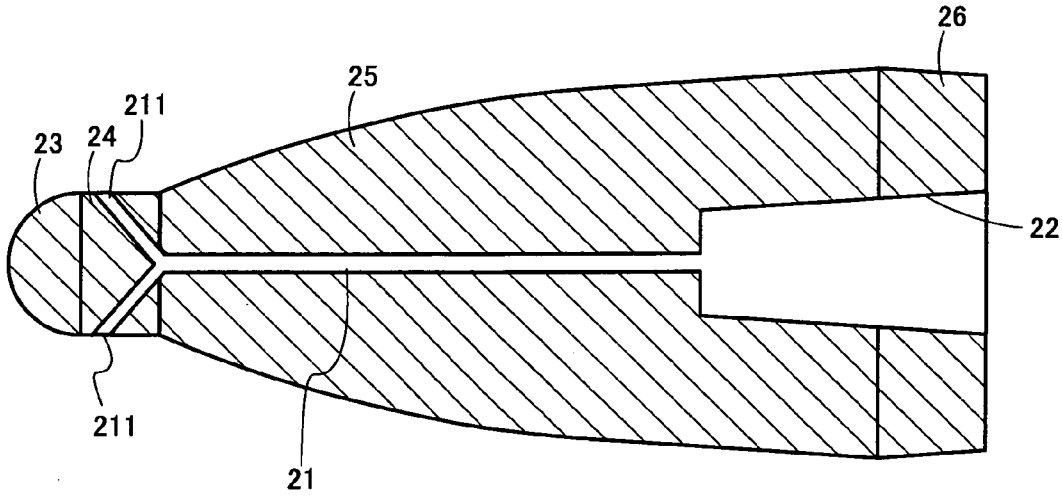
FIG. 5 is a longitudinal sectional view of another plug having a different shape from those in FIGS. 2A, 2B, and 4.

If the opening 211 is formed at the surface of the cylindrical portion 24, inner surface defects caused by the contact between the opening 211 and the billet 50 can be prevented. Therefore, as shown in FIG. 5, the opening 211 may be formed at the front end of the surface of the cylindrical portion 24. Alternatively, the opening 211 may be formed at the central part of the surface of the cylindrical portion 24. As shown in FIGS. 2A and 2B, if the opening 211 is formed at a part of the surface of the cylindrical portion 24 adjacent to the barrel portion 25, the injection hole 21 can be prevented most effectively from being clogged with the solidified lubricant 41. Herein, the adjacent part refers to for example a part in the range from the center of the surface of the cylindrical portion 24 to the rear end of the surface of the cylindrical portion 24. The opening 211 is preferably provided at a part in the range of ¼ of the entire length of the cylindrical portion from the rear end of the surface of the cylindrical portion 24 toward the front end.

The above-described plug has two openings 211, but there may be only one opening 211 or three or more such openings 211 may be provided according to the embodiment.

The surface of the cylindrical portion 24 may be a cylindrical shape having a fixed diameter or a tapered shape having a small taper angle. However, if it has the tapered shape, the taper angle must be such an angle that keeps the inner surface of the billet in the process of piercing and rolling from contacting the surface of the cylindrical portion 24. In short, as long as there is the clearance 60 between the billet 50 and the cylindrical portion 24, the shape may be a tapered shape.

In this description, the cylindrical shape and the tapered shape having a tapered angle that keeps the cylindrical portion from contacting the billet during piercing is collectively referred to as "substantially cylindrical shape."

The length L1 (mm) of the cylindrical portion 24 is preferably not less than a prescribed length. If the length L1 is long to some extent, the heat capacity of the cylindrical portion 24 is large, so that the cylindrical portion 24 can be prevented from deforming by the heat of the billet. However, the cylindrical portion 24 does not contribute to the piercing and rolling operation, and therefore if the cylindrical portion 24 is too long, the piercing and rolling operation may be unstable, which could give rise to fluctuations in the thickness and the outer diameter. Therefore, the length L1 of the cylindrical portion 24 preferably satisfies the following Expression (1):

$$0.05\times BD \leqq L1 \leqq 0.30\times BD \quad (1)$$

where BD represents the diameter (mm) of the billet (round billet).

EXAMPLE 1

Plugs having various shapes were produced, round billets as the material were pierced into hollow shells using them, and then the hollow shells were inspected for the presence/absence of inner surface defects.

Figure 6A:
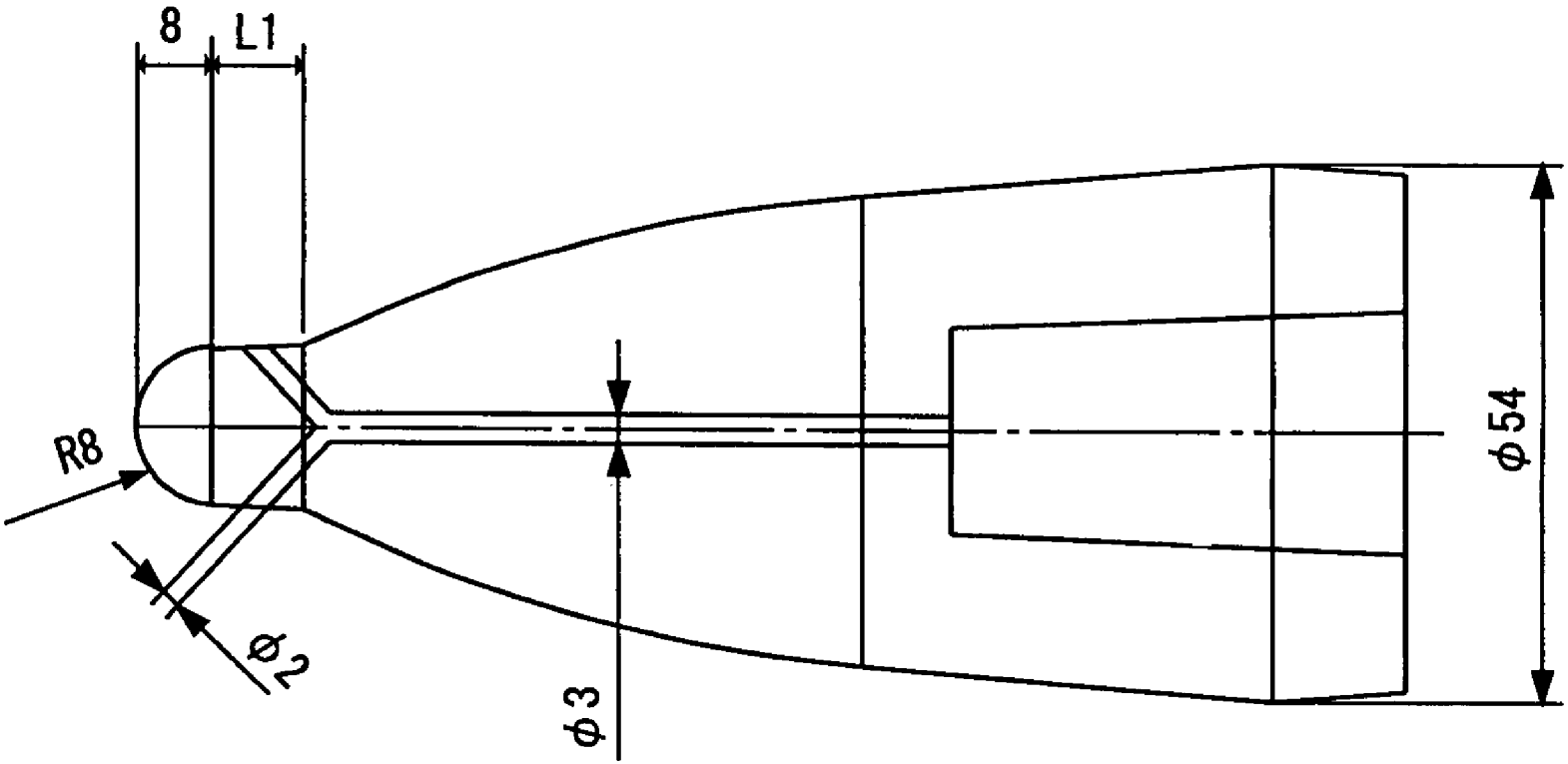
FIG. 6A is a side view of a plug used in an example.

The sizes of the plugs used for the piercing/rolling tests were as shown in FIG. 6A. In FIG. 6A, the unit of sizes is mm. The length L1 of the cylindrical portion in FIG. 6A was as shown in Table 1.

TABLE 1

| test No. | plug shape: opening position | plug shape: L1 (mm) | round billet: diameter BD (mm) | Exp. 1 | inner surface defect | hole clogging | state of cylindrical portion | piercing/rolling stability |
|---|---|---|---|---|---|---|---|---|
| 1 | barrel portion | 7.5 | 70 | ○ | X | X | ○ | ○ |
| 2 | rear end of cylindrical portion | 7.5 | 70 | ○ | ○ | ◎ | ○ | ○ |
| 3 | front end of cylindrical portion | 7.5 | 70 | ○ | ○ | ○ | ○ | ○ |
| 4 | rear end of cylindrical portion | 3 | 70 | X | ○ | ◎ | Δ | ○ |
| 5 | rear end of cylindrical portion | 22 | 70 | X | ○ | ◎ | ○ | X |

Figure 6B:
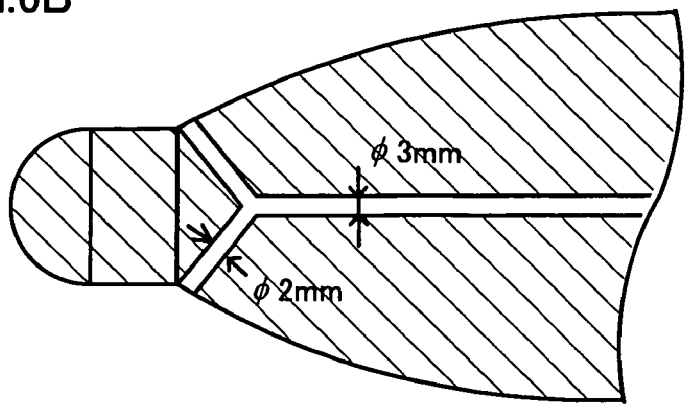
FIG. 6B is a longitudinal sectional view of the plug showing the opening position of the injection hole of the plug used in the example.
Figure 6C:
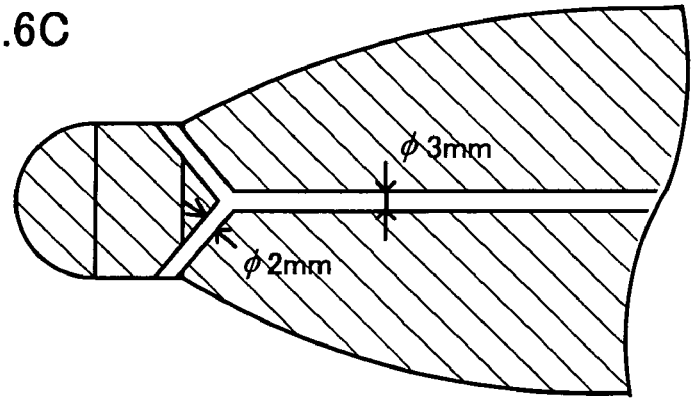
FIG. 6C is a longitudinal sectional view of a plug having an opening position different from that in FIG. 6B.
Figure 6D:
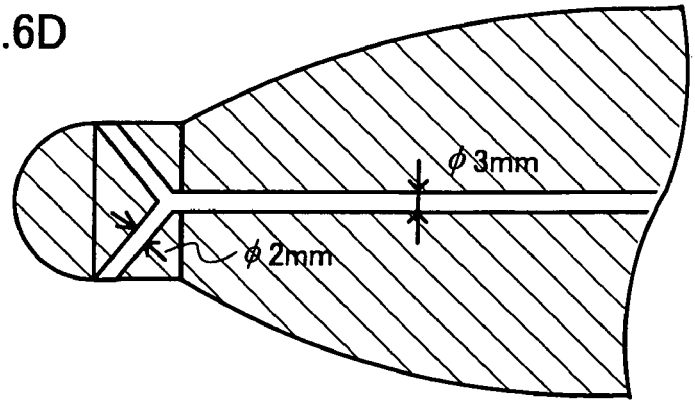
FIG. 6D is a longitudinal sectional view of a plug having an opening position different from those in FIGS. 6B and 6C.
Figure 7:
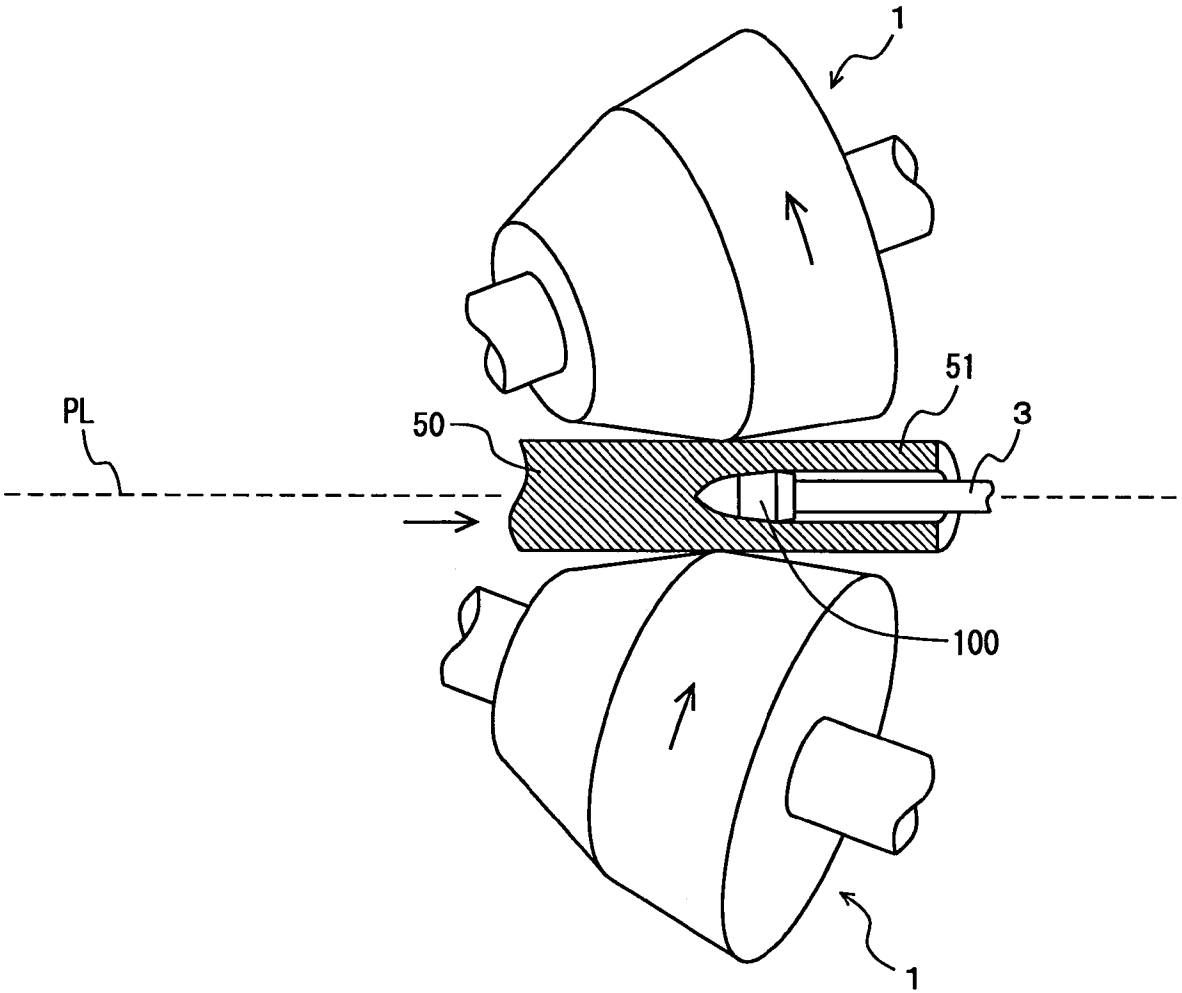
FIG.7 PRIOR ART
FIG. 7 is a schematic view for illustrating how a billet is pierced using a conventional piercer.
Figure 8:
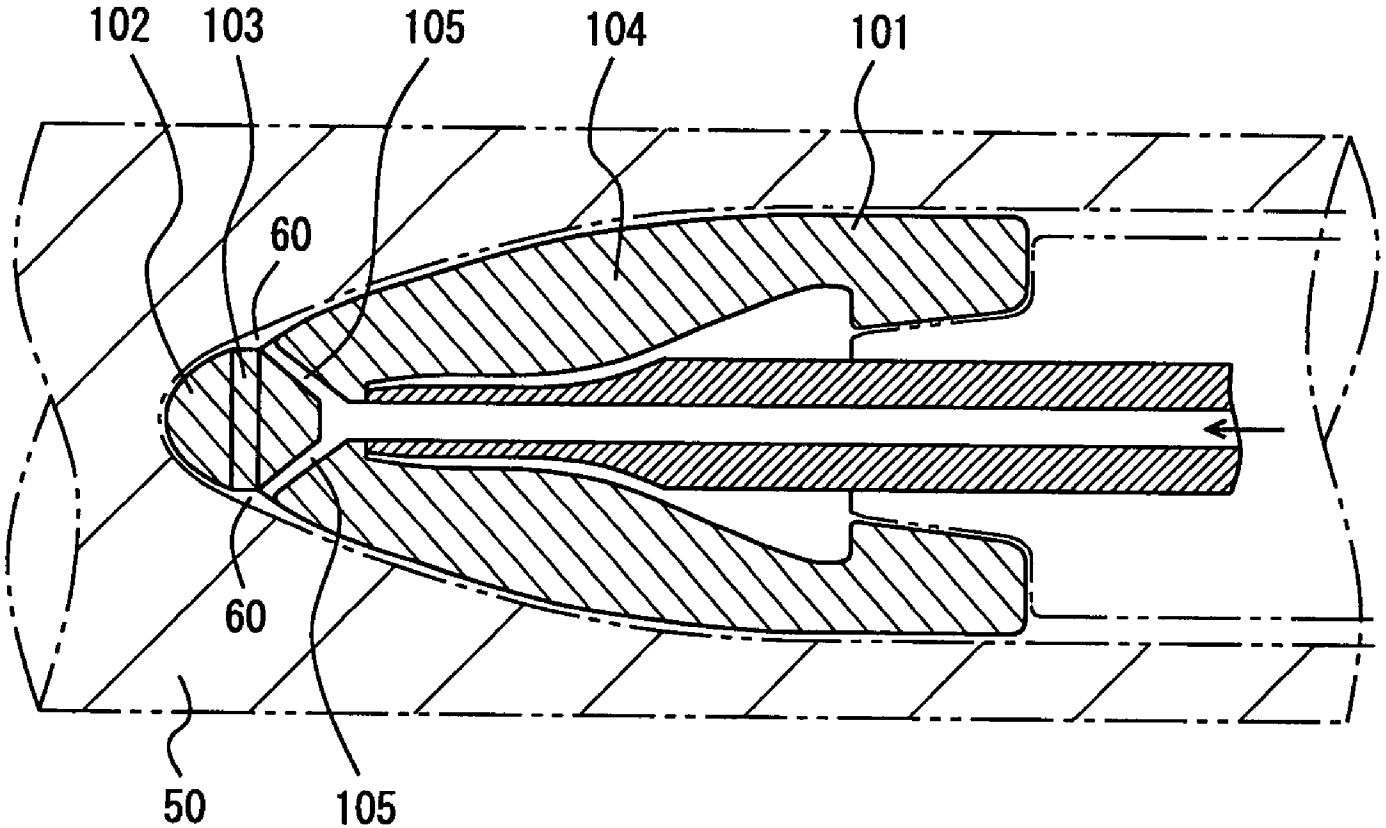
FIG.8 PRIOR ART
FIG. 8 is a longitudinal sectional view of the conventional plug.

As shown in FIG. 6B, the plug with Test No. 1 had an injection hole opening at a part of the barrel portion adjacent to the cylindrical portion. As shown in FIG. 6C, the plug with Test No. 2 had an injection hole opening at a part of the cylindrical portion adjacent to the barrel portion. As shown in FIG. 6D, the plug with Test No. 3 had an injection hole opening at a part of the cylindrical portion adjacent to the tip end. The lengths L1 of the cylindrical portions of the plugs with Test Nos. 1 to 3 were each 7.5 mm.

The plug with Test No. 4 had an injection hole opening in the same position as that of the plug with Test No. 2, but the length L1 of the cylindrical portion was 3 mm, which was shorter than that of Test No. 2. The length L1 of the cylindrical portion of the plug with Test No. 5 was 22 mm, which was longer than that of Test No. 2.

The round billets to be pierced were produced by the following method. A 2Cr steel containing 2% Cr by mass was melted and produced into a round billet having a diameter of 225 mm by a continuous casting method. Then, the outer periphery of the round billet was cut until the diameter was 70 mm. A plurality of round billets having a diameter of 70 mm and a length of 300 mm produced by the above described method were prepared.

These test plugs were each attached to a piercer having the same structure as that in FIG. 1 and five round billets having diameters shown in Table 1 for respective test numbers were continuously pierced and rolled into hollow shells. During the piercing and rolling operation, a glass-based lubricant having a composition shown in Table 2 was injected from the plugs. Note that the conditions for the piercer for respective test numbers were as given in Table 3.

TABLE 2

| Composition | content (% by mass) |
|---|---|
| Borate | 5.0 to 20.0 |
| water-swelling layered material | 10.0 to 30.0 |
| viscosity modifier | 0.5 to 3.0 |
| water | 40.0 to 70.0 |

TABLE 3

| test No. | tilt angle (°) | disk opening (mm) | roll opening (mm) | lead (mm) |
|---|---|---|---|---|
| 1 | 10 | 71.5 | 60.8 | 40 |
| 2 | 10 | 71.5 | 60.8 | 40 |
| 3 | 10 | 71.5 | 60.8 | 40 |
| 4 | 10 | 71.5 | 60.8 | 40 |
| 5 | 10 | 71.5 | 60.8 | 40 |

After the piercing and rolling, it was determined by eyes if there was an inner surface defect at the produced hollow shells. It was determined by eyes whether the openings of the injection holes of the plugs were clogged after the piercing.

For the hollow shells with the respective test numbers, the stability during the piercing and rolling operation was examined by the following method. The outer diameter was measured at ten points in the range of 20% of the entire length of the hollow shell both to the right and left from the center of the length of the hollow shell as the reference point, and the average of the results (average outer diameter) was calculated. The outer diameters of the hollow shell at both ends (end outer diameters) were measured. If the difference between each of the end outer diameters and the average diameter was not more than 1.05% of the average diameter, it was determined that the piercing and rolling operation was stable ("O" in the table). If the difference exceeded 1.05%, it was determined that the piercing and rolling operation was unstable ("x" in the table).

Test Results

The results of the tests are given in Table 1. In Table 1, "O" in the "inner surface defect" column represents the absence of an inner surface defect, and "x" represents the presence of an inner surface defect. In Table 1, "◎" in the "hole clogging" column indicates that no solidified lubricant was deposited at the injection hole, "O" indicates that a small amount of the lubricant was deposited on the surface of the injection hole though the injection hole was not clogged, and "x" indicates that the injection hole was clogged.

Referring to Table 1, inner surface defects were generated only at the hollow shell with Test No. 1. As a result of observation of the injection hole opening, the upper side of the opening was eroded. It is considered that the round billet contacted the opening and the inner surface defect was caused. Furthermore, the lubricant was solidified in the injection hole. Therefore, it was considered that the injection hole was clogged during the piercing and the inner surface defect attributable to the crack due to the Mannesmann effect was probably caused as well.

Meanwhile, the hollow shells with Test Nos. 2 to 5 had no inner surface defect ("O" in the table). As a result of observation of the injection hole openings, the solidified lubricant was not deposited on the plugs with Test Nos. 2, 4, and 5. Meanwhile, the plug with Test No. 3 did not have its injection hole clogged but a small amount of solidified lubricant was deposited on the inside of the injection hole.

The plugs with the respective test numbers were inspected by eyes for the shape of the plug cylindrical portion after the piercing and rolling. The plugs with Test Nos. 1 to 3 satisfied Expression (1), and therefore no deformation was observed at the cylindrical portion ("O" in the table). Meanwhile, the cylindrical portion of the plug with Test No. 4 that did not satisfy Expression (1) had slight deformation at the adjacent portion to the tip end. The deformation was not great enough to form an inner surface defect ("Δ" in the table), but it was expected that an inner surface defect could have been caused if the plug continued to be used for piercing and rolling.

The plug with Test No. 5 having the long cylindrical portion did not satisfy Expression (1) and the piercing and rolling operation was unstable.

Although the present invention has been described and illustrated in detail, it is clearly understood that the same is by way of illustration and example only and is not to be taken by way of limitation. The invention may be embodied in various modified forms without departing from the spirit and scope of the invention.

The invention claimed is:

1. A piercer for piercing and rolling a round billet in the axial direction to form the round billet into a hollow shell, comprising:

a plug having an injection hole for injecting a lubricant;

a mandrel having a through hole in the axial direction for providing the lubricant therethrough and having a tip end coupled with the rear end of said plug; and an injection device injecting the lubricant from said injection hole through said through hole, said plug comprising:

a tip end portion having a raised curvature in the axial direction;

a cylindrical portion adjacent to said tip end portion and having a substantially cylindrical surface;

a barrel portion adjacent to said cylindrical portion and having an outer diameter gradually increased from a front end to a rear end thereof; and a mandrel coupling portion provided at the rear end of said plug to couple with said mandrel, said injection hole penetrating from the surface of said cylindrical portion to a surface of said mandrel coupling portion and being communicated with said through hole, and a length L1 (mm) of said cylindrical portion satisfying the following Expression (1):

$$0.05\times BD \leqq L1 \leqq 0.30\times BD \quad (1)$$

where BD represents the diameter (mm) of the round billet.

2. The piercer according to claim 1, wherein said injection hole penetrates from a part of the surface of said cylindrical portion adjacent to said barrel portion to the surface of said mandrel coupling portion.

3. A method of manufacturing a seamless pipe or tube using a piercer comprising:

a plug having an injection hole for injecting a lubricant;

a mandrel having a through hole in the axial direction for providing the lubricant therethrough and having a tip end coupled with the rear end of said plug; and an injection device injecting the lubricant from said injection hole through said through hole, said plug comprising:

a tip end portion having a raised curvature in the axial direction;

a cylindrical portion adjacent to said tip end portion and having a substantially cylindrical surface;

a barrel portion adjacent to said cylindrical portion and having an outer diameter gradually increased from a front end to a rear end thereof; and a mandrel coupling portion provided at the rear end of said plug to couple with said mandrel, said injection hole penetrating from the surface of said cylindrical portion to a surface of said mandrel coupling portion and being communicated with said through hole, and a length L1 (mm) of said cylindrical portion satisfying the following Expression (1):

$$0.05\times BD \leqq L1 \leqq 0.30\times BD \quad (1)$$

where BD represents the diameter (mm) of a round billet, said method, comprising the steps of:

piercing and rolling a round billet in the axial direction; and injecting said lubricant from the injection hole of said plug while said round billet is pierced and rolled.

4. A plug for use in a piercer for piercing and rolling a round billet in the axial direction to form the round billet into a hollow shell, comprising:

a tip end portion having a raised curvature in the axial direction;

a cylindrical portion adjacent to said tip end portion and having a substantially cylindrical surface;

a barrel portion adjacent to said cylindrical portion and having an outer diameter gradually increased from a front end to a rear end thereof;

a mandrel coupling portion provided at the rear end of said plug to couple with a mandrel; and an injection hole penetrating from the surface of said cylindrical portion to the surface of said mandrel coupling portion and injecting a lubricant, and a length L1 (mm) of said cylindrical portion satisfying the following Expression (1):

$$0.05 \times BD \leqq L1 \leqq 0.30 \times BD \quad (1)$$

where BD represents the diameter (mm) of the round billet.

5. The plug according to claim 4, wherein said injection hole penetrates from a part of the surface of said cylindrical portion adjacent to said barrel portion to the surface of said mandrel coupling portion.

6. The method according to claim 3, wherein said injection hole penetrates from a part of the surface of said cylindrical portion adjacent to said barrel portion to the surface of said mandrel coupling portion.

* * * * *